United States Patent [19]

Hoogeveen

[11] 4,009,925

[45] Mar. 1, 1977

[54] DETACHABLE CONNECTION BETWEEN TWO ELECTRIC CONDUCTORS

[75] Inventor: Frank Hoogeveen, Rohrmoos, Germany

[73] Assignee: Maschinenfabrik Augsburg-Nurnberg AG, Munich, Germany

[22] Filed: July 22, 1976

[21] Appl. No.: 707,782

Related U.S. Application Data

[62] Division of Ser. No. 560,912, March 21, 1975, abandoned.

[30] Foreign Application Priority Data

Mar. 27, 1974 Germany ..... 2414822
Aug. 16, 1974 Germany ..... 2439370

[52] U.S. Cl. ..... 339/273 R; 174/94 R; 339/277 R; 403/300

[51] Int. Cl.[2] ..... H01R 7/02

[58] Field of Search ..... 339/9, 22, 30, 48, 100, 339/49 B, 263 E, 273, 277, 278; 174/94 R, 94 S; 403/300, 339

[56] References Cited

UNITED STATES PATENTS 2,097,324 10/1937 Hill ..... 339/22 B

FOREIGN PATENTS OR APPLICATIONS 483,133 1/1970 Switzerland ..... 174/94

*Primary Examiner*—Joseph H. McGlynn
*Attorney, Agent, or Firm*—Alan H. Levine

[57] ABSTRACT

A connection comprising two electrical conductor ends and a connection member fastened between them. The connection member does not extend beyond the external cross-sectional contour of the conductor ends, and preferably is formed of a material, such as silver, having higher electrical conductivity than the material of the conductor ends. The contact surfaces may be coated with gold. Alternatively, the connector member may be formed of copper, and the contact surfaces coated with silver. The connector member may overlap the end portions of the conductor ends, and pins arranged in aligned holes in the connector member and end portions. The connector member may be stepped, with a pin at each step, and may be formed of one piece or a series of strips one upon another. The pins may be formed as one piece with the connector member. The spacing between the pins may be greater than the holes which accommodate them.

14 Claims, 3 Drawing Figures

FIG. 1
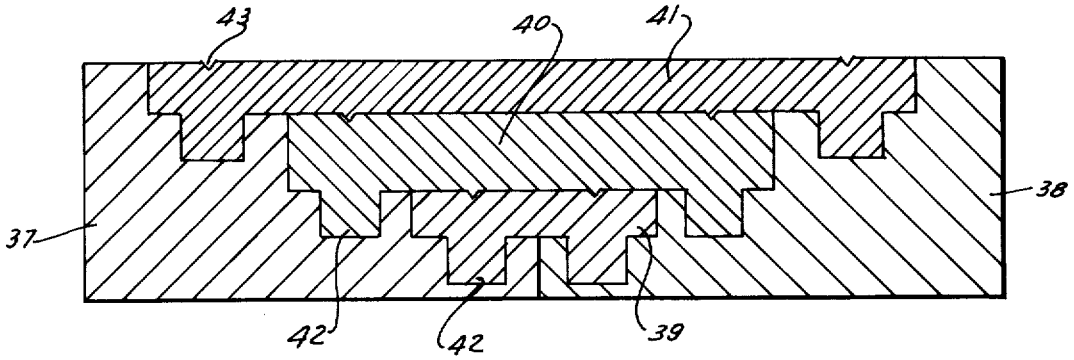
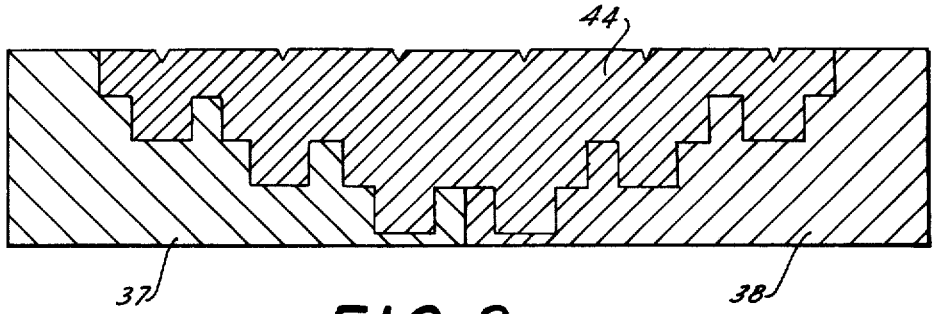
FIG. 2
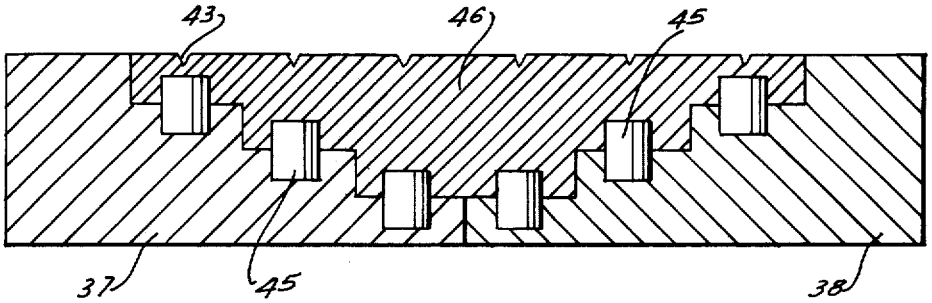
FIG. 3

DETACHABLE CONNECTION BETWEEN TWO ELECTRIC CONDUCTORS

This application is a division of application Ser. No. 560,912, filed Mar. 21, 1975, now abandoned.

The present invention relates to a removable connection between two electric conductors, particularly conductors made of copper.

In special cases, such as for instance the helix coil in a nuclear fusion plant where individual turns are arranged close together, it was heretofore necessary to remove an entire electric conductor if due to physical reasons space was not available for a detachable connection. Such physical reasons can be for example, the precisely determined form of a conductor forming a turn of a helix coil at a slight distance from the next turn, as well as in the need for minimum resistance, or else mechanical requirements such as transmission of force (4.5 tons in the case of a helix coil), or susceptibility to overheating.

Previous methods, such as for instance soldering, are not considered since the resistance of the solder point would be too great; brazing with gold or silver solder frequently is not considered because of the high temperatures and furthermore it represents a connection which is not removable. The object of the present invention is to provide a removable connection between two electric conductors which avoids the above-indicated disadvantages.

This object is achieved, in accordance with the invention, in a manner whereby both ends of the electrical conductors are securely connected with a connecting member of high conductivity whose diameter is as large as or smaller than that of the electric conductors and is flush with the two ends thereof. In this case, the arrangement of the conductors is not disturbed since the connecting member does not pass beyond the outer contours of the two conductors, its high conductivity assuring a low resistance of the connection, and the secure attachment handling the transmission of force. The connection of the invention satisfies, in particular, the specific requirements made on a helix coil which must not be removed but must be able to be opened in case of need since the physical properties of each of the individual turns is not impaired by a double connection; if the length of conductor lying between the connections is removed in each turn then the inside of the coil is open for further work; in this case the loosening and closing of the connections can be effected as frequently as desired.

In one embodiment of the invention, the connecting member consists of material of higher electrical conductivity than the electrical conductors; in this way a connector member can be used which has a substantially smaller diameter than the electrical conductors to be connected, it not being necessary for the two electrical conductors to be in contact with each other, but rather they need merely retain contact with the connector member. If the point of connection lengthens for instance under the action of a tensile force, this has no substantial effect on the electrical resistance of the connection.

In another embodiment of the invention, the connector member consists of silver. Silver, or its base alloys, combine the properties of easy workability, sufficiently high strength, low electrical resistance, and a price which is still practical.

Another feature of the invention is the fact that the ends of the electrical conductor and/or the connector member are provided at least in part with a coating and particularly a coating of gold. The coating constitutes protection against oxidation and is preferably of soft material, such as for instance gold, which adheres closely to the irregularities of a pressing surface. In this case the coating has special electrical properties so that all of its properties together result in improving the electrical contact. Such a coating can furthermore also consist in wetting by a contact-promoting liquid which then fills up all spaces between conductor and connector.

In another embodiment of the invention, the connector member is connected in a more positive locked manner with the two ends of the electrical conductors. In this way, even after frequent removal and insertion of the connector members a firm connection is at all times maintained. This embodiment furthermore proposes, preferably, the use of transverse pins as form-locked connecting elements; in this case the transverse pins can be designed as dowel pins which then are knocked or drilled out when the connection is to be opened; after the calibrating of the bore hole new dowel pins are hammered home to make a new connection.

Another embodiment of the invention comprises the connector member being stepped-down on both sides in an axial direction, each step having at least one bore hole which is connected by a pin with one of the two conductors. In this way there is created a large contact surface as well as the possibility of transmitting tension forces via several pins; thus the electrical contact resistance is reduced and the damaging of pins and bore holes avoided. By slight mutual staggering of the bore holes the connector member can be pretensioned when mounted, whereby a loosening of the connector member and thus an increase in the contact resistance are effectively avoided.

In another embodiment of the invention, the connector member consists of individual elements of different lengths laid on top of one another, each end of each element having at least one bore hole. The individual elements can be cut out of low-cost extruded material, in which connection, in the case of mounting in layers, it can be seen to it that in each case from layer to layer bracings are provided which prevent loosening in operation.

A further object of the invention is to create a connector member which is simple to manufacture, capable of taking up substantial tensile loads, and is cheap so that it can be used without great additional expense; insofar as the connector member must be destroyed upon the opening of the connection, it is necessary in particular to see to it that the connector member is relatively cheap.

This object is achieved, in accordance with the invention, by fabricating the connector member essentially of copper. Copper, in addition to silver, has an extremely high electrical conductivity which is surpassed only by that of silver. Accordingly, it has also been proposed above to manufacture the connector member of silver. Furthermore, it is usually believed that silver affords far better protection against corrosion than copper does.

However, it has been found that copper is practically as resistant to corrosion as silver and what is more is able to transmit far greater tensile forces than silver. In this connection, it must be borne in mind that both copper and silver must be used in the purest possible metallic form since the conductivity of the two metals decreases when impurities are present.

In order to obtain particularly good conductivity at the contact surfaces, in accordance with another feature of the invention, the contact surfaces of the connector member and of the conductors are provided with a coating, in particular of silver. This coating serves not only for local improvement in electrical conductivity and transmitting power, but also to see to it that at both contact surfaces of a contact joint the same metal is always present, so that in this way development of a local electric cell which might lead to corrosion is prevented.

In another embodiment of the invention, the connector member has pin-like projections which engage in corresponding depressions in the electrical conductors. In this way there is assurance that the two ends of the conductors are held together in a positively locked manner. By the provision of the pin-like projections on the connector member, or on the individual parts of a multipartite composite connector member, the connection however can be opened at any time by drilling out the pins without the depressions in the electrical conductor being damaged. In this case, it is merely necessary to repair the connector member or provide a new connector member, which does not represent an excessive cost in view of the copper connector member used in accordance with the invention. For this purpose, opposite each of the pin-like projections there is provided a countersunk indentation which facilitates the exact boring out of the pinlike projection.

In another embodiment of the invention, the connector member and projections are of one piece. Even complicated surface shapes can be produced relatively simply and economically from copper, either by a galvanoplastic surface forming or by traditional machining processes. Therefore, in all cases there is only one path of current in each case between conductor and connector member, and not also a second path between the connecting pin and the connector member. Furthermore, in this embodiment the point of connection is covered and protected so that moisture cannot penetrate for instance through hairline cracks and then lead to corrosion.

Another feature of the invention is the fact that the surface is free of projections and/or depressions. In this way, there is assurance that the contacting surfaces form a connection which is as close as possible and in which intermolecular bonds can even be active, whereby a particularly high conductivity is assured.

Another feature of the invention is the fact that the projections are accommodated with a force fit in the depressions. In this way, not only a dependable mechanical connection is obtained, but also a dependable electrical connection.

A further feature of the invention involves the connector member having at least one projection at each end, the distance between the projections being less than the distance between the depressions in the two conductors. If the connector member is then forcefully introduced into the two depressions in the conductors, the end surfaces of the conductors are pressed against each other at the place of separation, whereby an additional current-transmitting connection is created.

The invention is explained further, in the form of examples, in the drawings:

FIG. 1 shows a connection, in accordance with the invention, between two electrical conductors 37 and 38 by means of partial connector members 39, 40, and 41 placed one above the other, each of which has a pin-shaped projection 42 near each end. The projections 42 are accommodated in depressions formed in the ends of the two electrical conductors. Opposite the projections there is in each case provided a countersunk depression 43 which facilitates the drilling out of the projections.

FIG. 2 shows an example of a use of the invention which is similar to that shown in FIG. 1; however, the connector member 44 is not divided into three individual partial connector members lying one above the other but is formed completely in one piece.

In the examples of FIGS. 1 and 2 the passage of electric current through the pin-shaped projections which are inserted with a force fit must be equal to or greater than the possible transfer or current at the narrowest point of the overall transfer and therefore approximately at the place where the two electrical conductors meet.

FIG. 3 shows an arrangement which is similar to the one shown in FIG. 2; however, the pin-shaped projections are not of one piece with the connector 46, but are separate inserted pins 45. This embodiment is characterized by its particularly low price.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A detachable electrical connection comprising two electrical conductor ends to be connected, and a connector means fastened between said conductor ends, the cross-sectional dimension of said connector means being no larger than the corresponding cross-sectional dimensions of said conductor ends, each of said conductor ends having a multiple stepped configuration tapering toward the other conductor end, each step of each conductor end cooperating with the corresponding step of the other conductor end to define an axially extending groove, each groove being longer than the groove immediately beneath it, and each step of each conductor having a transverse bore, and said connector means having a stepped configuration corresponding to that of said grooves, each step of said connector means having a pin extending into the bore in the corresponding step of one of said conductor ends.

2. A detachable electrical connection as defined in claim 1 wherein said pins are force fit into said bores.

3. A detachable electrical connection as defined in claim 1 wherein prior to assembly of said connector means and said conductor ends the axial spacing between the two bores in each groove is greater than the axial spacing between the two pins which are accommodated by those two bores.

4. A detachable electrical connection as defined in claim 1 wherein said conductor means is formed of a single piece of material.

5. A detachable electrical connection as defined in claim 1 wherein said connector means and pins are formed of a single piece of material.

6. A detachable electrical connection as defined in claim 1 wherein each step of said connector means has a bore aligned with the corresponding bore in said connector ends, and each of said pins is a separate element fitted into a pair of said aligned bores.

7. A detachable electrical connection as defined in claim 1 wherein said connector means comprises a plurality of separate bars, each bar fitting snugly into one of said grooves, and each bar having two of said pins accommodated by the two bores in the steps defining its respective groove.

8. A detachable electrical connection as defined in claim 7 wherein the upper surface of each bar is flush with the upper edge of its respective groove.

9. A detachable electrical connection as defined in claim 1 wherein said connector means is formed of material having higher electrical conductivity than the material of said conductor ends.

10. A detachable electrical connection as defined in claim 9 wherein said connector means is made of silver.

11. A detachable electrical connection as defined in claim 10 wherein the surfaces of at least one of said connector means and said conductor ends which engage each other are coated with gold.

12. A detachable electrical connection as defined in claim 1 wherein said connector means is formed essentially of copper.

13. A detachable electrical connection as defined in claim 12 wherein the contact surfaces of said connector means and conductor ends are coated with silver.

14. A detachable electrical connection as defined in claim 12 wherein the contact surfaces of said connector means and conductor ends are smooth.

* * * * *